United States Patent [19]

Kipphan et al.

[11] Patent Number: 5,029,526

[45] Date of Patent: Jul. 9, 1991

[54] METHOD AND APPARATUS FOR SETTING THE STARTING TIME OF TRANSVERSE INK DISTRIBUTION FOR PRINTING MACHINES

[75] Inventors: Helmut Kipphan, Schwetzingen; Gerhard Löffler, Walldorf; Werner L. Giesa, Beerfelden, all of Fed. Rep. of Germany

[73] Assignee: Heidelberger Druckmaschinen AG, Heidelberg, Fed. Rep. of Germany

[21] Appl. No.: 412,917

[22] Filed: Sep. 26, 1989

Related U.S. Application Data

[63] Continuation-in-part of Ser. No. 43,845, Apr. 29, 1987.

[30] Foreign Application Priority Data

Apr. 29, 1986 [DE] Fed. Rep. of Germany ..... 3614555

[51] Int. Cl.[5] ..... B41F 33/10; B41F 31/00

[52] U.S. Cl. ..... 101/350; 101/DIG. 38

[58] Field of Search ..... 101/350, 349, 351, 352, 101/365, DIG. 32, DIG. 45, DIG. 47, DIG. 38

[56] References Cited

U.S. PATENT DOCUMENTS 4,205,605 6/1980 Greiuer et al. ..... 101/206
4,681,455 7/1987 Jeschke et al. ..... 356/380 X

FOREIGN PATENT DOCUMENTS 1503117 3/1978 United Kingdom .
1525244 9/1978 United Kingdom .

*Primary Examiner*—Clifford D. Crowder
*Attorney, Agent, or Firm*—Herbert L. Lerner; Laurence A. Greenberg

[57] ABSTRACT

A method of setting the starting time of transverse ink distribution for printing machines, which comprises determining impression-area dispersion on a printing plate and, in conjunction with parameters specific to the printing machine which affect ink dispersion on a printed sheet, calculating an optimum starting time of transverse ink distribution.

17 Claims, 5 Drawing Sheets

Microfiche Appendix Included
(1 Microfiche, 18 Pages)

MEASURED - VALUE MATRIX

| | | | | | | | |
|---|---|---|---|---|---|---|---|
| $X_{1.1}$ | $X_{2.1}$ | $X_{3.1}$ | $X_{4.1}$ | $X_{5.1}$ | $X_{6.1}$ | $X_{7.1}$ | $X_{8.1}$ |
| $X_{1.2}$ | $X_{2.2}$ | $X_{3.2}$ | $X_{4.2}$ | $X_{5.2}$ | $X_{6.2}$ | $X_{7.2}$ | $X_{8.2}$ |
| $X_{1.3}$ | $X_{2.3}$ | $X_{3.3}$ | $X_{4.3}$ | $X_{5.3}$ | $X_{6.3}$ | $X_{7.3}$ | $X_{8.3}$ |
| $X_{1.4}$ | $X_{2.4}$ | $X_{3.4}$ | $X_{4.4}$ | $X_{5.4}$ | $X_{6.4}$ | $X_{7.4}$ | $X_{8.4}$ |
| $X_{1.5}$ | $X_{2.5}$ | $X_{3.5}$ | $X_{4.5}$ | $X_{5.5}$ | $X_{6.5}$ | $X_{7.5}$ | $X_{8.5}$ |

SUMS BY ZONES AND TRANSVERSE $A_1 = \sum X_{1.1} \ldots\ldots X_{1.5}$ $A_1 \ldots A_8$ = SUM PER INKING ZONE $B_1 = \sum X_{1.1} \ldots\ldots X_{8.1}$ $B_1 \ldots B_5$ = SUM TRANSVERSE TO PRINTING DIRECTION

METHOD AND APPARATUS FOR SETTING THE STARTING TIME OF TRANSVERSE INK DISTRIBUTION FOR PRINTING MACHINES

This is a continuation-in-part application of application Ser. No. 07/043,845, filed Apr. 29, 1989.

A microfiche appendix consisting of eighteen frames is attached as a part of this application setting forth a computer program (sixteen of the eighteen frames) for computing the starting times for transverse distribution according to the invention.

The invention relates to a method and apparatus for setting the starting time of transverse ink distribution for printing machines.

Printed products of offset printing machines have a so-called "ink tail-off" in the printing direction. In this connection, ink tail-off does not necessarily mean that the ink density decreases from the start of the print to the end of the print. This may be the case, but the opposite is also possible. Every other distribution in the printing direction also occurs, such as ink accumulation in the middle of the sheet, for example.

The causes of ink tail-off are, in particular, the construction of the inking unit as a whole, the considerably smaller circumference of the form rollers compared with the length of the printing, the timing of transverse ink distribution and the impression-area distribution on the respective printing plate.

It has been known heretofore that the extent and dispersion of ink tail-off on the printed sheet can be influenced by the transverse ink distribution. First, the level of the ink-distribution setting and, second, to a decisive extent, the so-called starting time of this ink distribution are of importance.

The latter is understood to be the timing of the transverse movement of the ink transfer or distributor roller in relation to the time-related position of the impression cylinder, e.g. the right-hand or left-hand dead center in relation to the start of printing.

Therefore, in addition to a facility for setting or adjusting the level or amount of transverse ink distribution, modern sheet-fed machines are also equipped with an apparatus for varying the starting time.

Examples of such machines are shown in West German Patent 24 43 504 and in East German Patent DDR P1 21 065.

In practice, however, such control means are difficult to use, because, with conventional processes, the optimum starting time can be found only by experimenting with the respective type form. Printing is performed with several different settings or adjustments and the result is evaluated, e.g. by densitometric ink measurement.

From "Der Polygraph 15–75, p. 948 to 949" a method is known wherein, to establish the optimum starting time of transverse ink distribution, theoretically only one specimen print is necessary at any random setting and wherein, on the basis of the result of this specimen print, the optimum setting can be established by using a table of curves.

Heretofore known methods of this general type are disadvantageous in that they are time-consuming, expensive and elaborate. In the last-mentioned method, although the amount of time required is reduced, a specimen print is still necessary, and using the table is not without problems.

It is an object of the invention, therefore, to provide a method and an apparatus for implementing the method which make it possible, largely automatically, to establish the optimum starting time for transverse ink distribution as a function of all influencing parameters including the respective type form.

With the foregoing and other objects in view, there is provided, in accordance with the invention, a method of setting the starting time of transverse ink distribution for printing machines, which comprises determining impression-area dispersion on a printing plate and, in conjunction with parameters specific to the printing machine which affect ink dispersion on a printed sheet, calculating an optimum starting time of transverse ink distribution.

The method according to the invention has the advantage that the setting or adjustment of the optimum value for the starting time of transverse ink distribution is largely automatic.

In accordance with another mode, the method according to the invention includes calculating the optimum starting time of transverse ink distribution directly with a computer of a measuring apparatus (e.g. a plate scanner), and calculating the impression-area i.e. "ink density" dispersion.

This further development makes it possible in advantageous manner to use those components and programs which are usually provided along with the measuring apparatus for calculating the ink demand. For calculating the optimum starting time of transverse ink distribution, this further development requires that the parameters of all relevant printing machines be stored in a memory assigned to the measuring apparatus.

In accordance with a further mode of the method, the result of the calculation is supplied to an output device. Thus, the value which has been calculated for the starting time of transverse ink distribution can first be assessed by an operator before the value is used for controlling the printing machine.

According to an added mode, the method of the invention includes reading off the result of the calculation from the output device and entering it manually into the control console or into the printing machine.

If the printing plate which has been measured with the measuring apparatus is to be used at a later time for printing, then, according to a further mode, the method of the invention includes storing the result of the calculation on a data carrier. Furthermore, the method includes transferring the result of the calculation via a data line to the control console of the printing machine.

In accordance with an additional mode, the method includes calculating the optimum starting time of transverse ink distribution in a computer of the control console of the printing machine after measuring the impression-area dispersion with a measuring apparatus and transferring the measurement result into the computer of the control console.

With this mode of the method according to the invention basically the same constructions as for the aforedescribed use of the computer of the measuring apparatus are possible. These constructions afford further modifications and additions without departing from the teaching of the invention. Thus, for example, the output device may be formed by a display device and/or by a printer. Manual entry or input of the result into the control console of the printing machine may also take place, after the result has been read off from the output device, by merely entering a command, this command effecting automatic transfer of the individual data.

In accordance with yet another mode, the method of the invention includes, using as a parametric value in calculating the optimum starting time of transverse ink distribution, impression area measured data for the entire printing plate, for inking zones, for zones transverse to the printing direction and/or for each individual measuring area.

This added mode may differ, depending upon the equipment used. For example, with the aid of a plate- or film-measuring device (scanner), the method includes calculating the impression-area data for individual measuring areas, and summing them for inking zones, for zones transverse to the printing direction and/or for the entire printing plate or for the entire printing film.

In accordance with an alternate mode, when an electronic composing system is used, the method according to the invention includes calculating the optimum starting time of transverse ink distribution with impression-area data contained in the electronic composing system for inking zones, for zones transverse to the printing direction of adjustable width and/or unit areas of adjustable size.

In accordance with another aspect of the invention, there is provided an apparatus for performing a method of setting the starting time of transverse ink distribution for printing machines, comprising a measuring system including a computer having a program appropriate to the method stored in a first memory of the computer, the computer having a second memory for parameters of at least one printing machine and including at least one of an output device and a data transfer for results of calculations performed by the computer.

In accordance with a concomitant and alternate aspect of the invention, there is provided an apparatus for performing a method of setting the starting time of transverse ink distribution for printing machines, comprising a control console of a printing machine including a computer, having a program appropriate to the method stored in a first memory of the computer, the computer having a second memory for parameters of the printing machine, and including at least one of an input device and a data-receiving device for impression-area dispersion values.

Other features which are considered as characteristic for the invention are set forth in the appended claims.

Although the invention is illustrated and described herein as embodied in a method and apparatus for setting the starting time of transverse ink distribution for printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1*a, b* and *c* is a flow chart of the method of setting the starting time of transverse ink distribution for printing machines according to the invention;

Figure 1A:
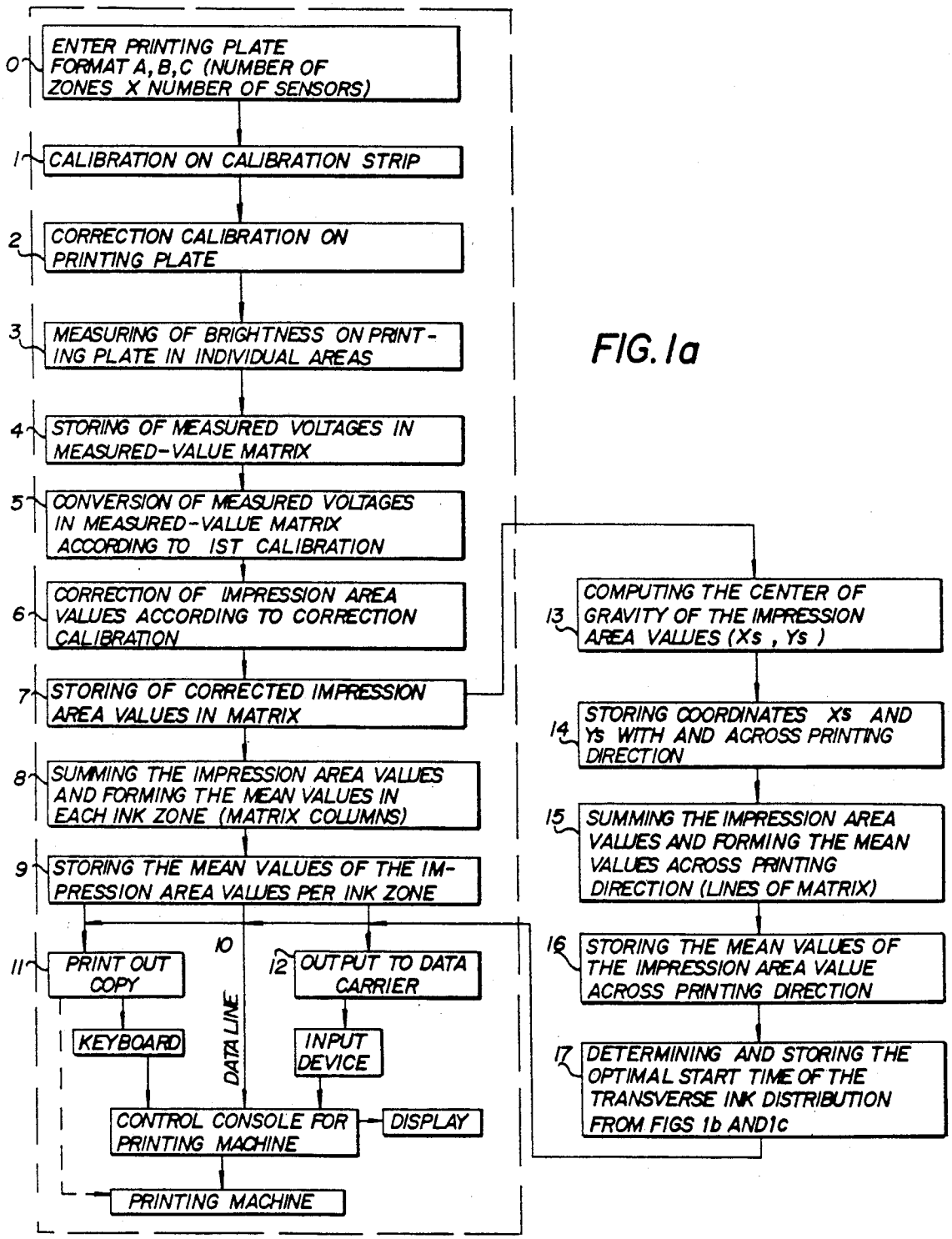

Referring now to the drawing and first, particularly, to FIG. 1, thereof, there are illustrated therein, method steps which are surrounded by a dot-dash line to indicate that they are already known from German Published Non-Prosecuted application DE 33 09 443 A1 and the corresponding U.S. Pat. No. 4,681,455 and constitute a method for calculating impression-area values and, consequently, the ink demand. This heretofore known method is in worldwide use as a program in the computer of the CPC 3 printing-plate scanner of Heidelberger Druckmaschinen Aktiengesellschaft.

Insofar as is necessary for an understanding of the invention, this method is discussed briefly hereinafter. In this regard, the printing plate is scanned strip by strip with a series of photosensitive cells. The light reflected by each measured field represents a value of the impression area within the respective measured area. Advantageously the impression area values of the printing plate are normalized. In the method step 0 of FIG. 1 the printing plate formats are entered in direction parallel with and perpendicular to the direction of printing. Before the printing plate is scanned, however, method step 1 involves a calibration by scanning a calibration strip with one field for minimum calibration and one field for maximum calibration. The calibration strip is as similar as possible to the printing plate with regard to its optical properties. Owing to possible deviations, there is a further calibration with the aid of a calibration field on the printing plate according to method step 2.

At 3, the brightness of the printing plate is then measured in individual areas, whereupon the measured voltages obtained are stored at 4 in a measured-value matrix. These are converted at 5 into impression-area values in accordance with the calibration in method step 1 and, at 6, the impression-area values are corrected in accordance with the correction calibration.

The corrected impression-area values are then stored in a matrix (method step 7). Thereafter, at 8, there is a summation of the impression-area values in inking zones, and mean values of the zones are formed, whereupon the result is stored at 9 for each inking zone. In order to preset the ink-metering ducts, these values are transferred to the control console of a printing machine (method step 10). Depending upon operational requirements, this may be done automatically via a data line. However, the impression-area values for each inking zone may also be printed out and entered manually into the control console of the printing machine (method step 11). Finally, in method step 12, the values may be output onto a data carrier which then, at the appropriate time, is put into a corresponding scanner of the printing machine.

In order to perform the steps according to the invention the corrected and stored impression area values according to step 7 are transferred to step 13 for computing the coordinates of the center of gravity of the impression area values. In step 14 the coordinates Xs (transverse to the printing direction) and Ys (parallel with the printing direction) are stored. In step 15 corrected impression area values from the matrix of step 7 of zones perpendicular to the printing direction are added up, their mean value formed, and next stored in step 16. In the next step 17, the process of forming and storing the starting time of the transverse ink distribution is described in more detail with reference to flow chart FIGS. 1*b* and 1*c*.

Figure 3:
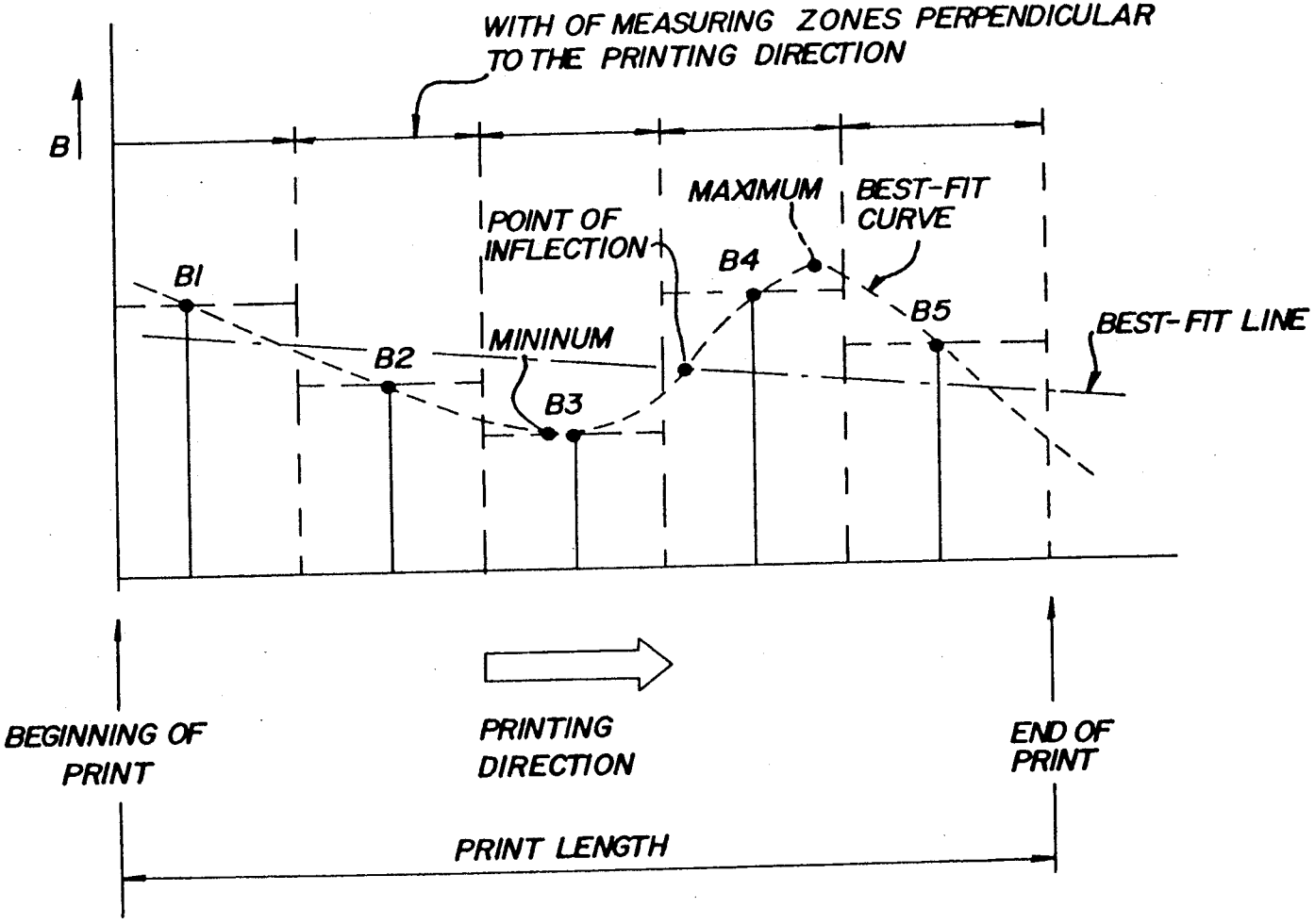
FIG. 3 is an example of an ink distribution curve in direction of printing, including a best-fit curve and a best-fit line.

Of the various possibilities of changing the starting time of the transverse ink distribution in sheet printing machines, it is also possible to determine the axial direction of motion of the distribution roller. As examples the distribution roller may be started at the moment the vibrating roller makes contact with the ink roller, in printing systems that have a vibrating roller, beginning the movement either from right to left or in the opposite direction. In that way, a gentle increase of the ink density on the respective left hand or right hand halfpart of the printed image is attained. From the fact that the position of the computed center of gravity, computed in step 13, is known, it is possible to determine which halfpart of the printed image is in greatest need of ink. In step 18 (FIG. 1*b*) it is determined, on the basis of the position of the center of gravity of the impression values, i.e. the Xs coordinate (perpendicular to the direction of printing) in which direction to start the distribution roller, and this determination (i.e. right-to-left or left-to-right) is stored in step 19. In step 20 the mean values of the impression area values in the printing direction are used to form a distribution curve that represents the impression area values in the printing direction, as shown in FIG. 3. In steps 21 to 24, a line of best fit is formed from the distribution curve in accordance with well-known methods, wherein the line of best fit is defined by:

$$Y=A_0+A_1x,$$

a curve of best fit, defined by:

$$Y=B_0+B_1x+B_2X^2+B_3X^3,$$

and the coefficients $A_i$ and $B_i$ are stored in memory. From coefficients $B_i$, the position of any points of inflection, minima and maxima are determined by means of the well-known methods of calculus, as shown in step 25, as these points appear in the direction of printing, and their coordinates are stored in memory. FIG. 3 shows as an example a curve of best fit drawn through coefficients B1–B5, having a maximum and a minimum, and a line of best fit, and a point of inflection at the intersection of the curve of best fit and the line of best fit.

In step 27 the distribution curve is divided into three classes, depending upon the slope ($A_i$) of the line of best fit. In response to the slope, the impression area distribution is classed as decreasing, increasing or even, in direction toward the end of printing. Step 28 shows the sequence of decisions leading to the final determination of starting point for the start of the transverse distribution. One of six points 1 . . . 6 in row A representing a machine plate format A represents the most advantageous starting point in regard to obtaining best uniformity of impression are distribution of a printed image. It should be understood that the points 1 . . . 6 each represents a relative point in time between the beginning of the print and the end along the line "printing length" in FIG. 3. The starting time or point in time is stored in memory in step 29.

Each starting point 1 . . . 6 corresponds to a typical distribution of the ink density in the direction of printing. Such ink distribution can be different for different types of machines, as determined by the printing plate format. For example, the starting point 2 of a printing machine with format A may correspond to starting point 5 of another machine type with format B. For that reason in step 28, the first row of starting points is shown in reference to plate format A, while another row is shown, but not filled out, referring to plate format B. These plate formats were entered in step 0 of the flow chart. The plate format can be used to identify a corresponding printing machine by means of a suitable table, which in turn can be used to determine the corresponding starting point. The starting point of the transverse distribution as computed above can be stored in memory in step 29 together with the direction of distribution, shown in step 19.

It follows that the result of the steps 13–29 may be used to directly control the ink feed of the machine.

Figure 1B:
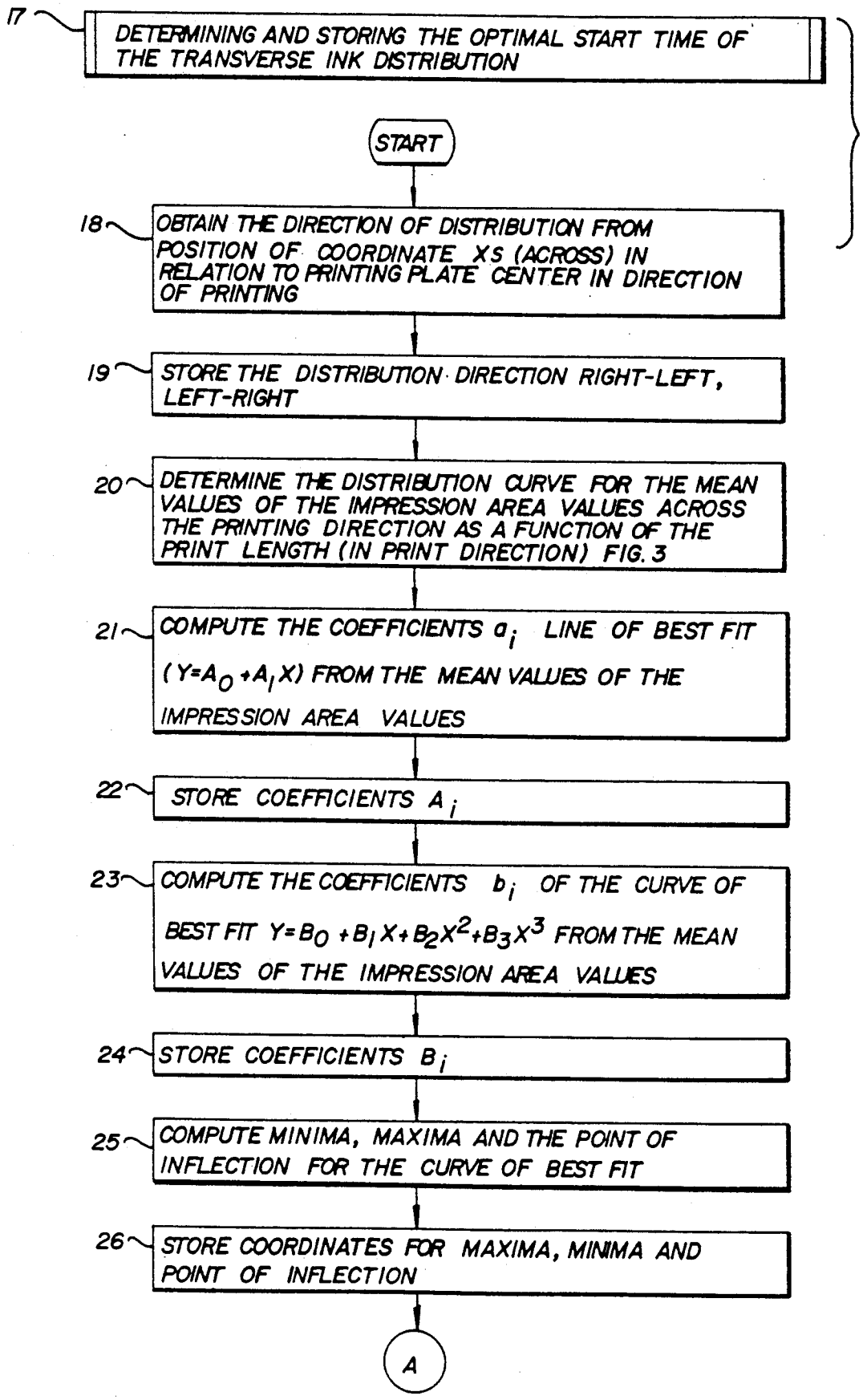
Figure 1C:
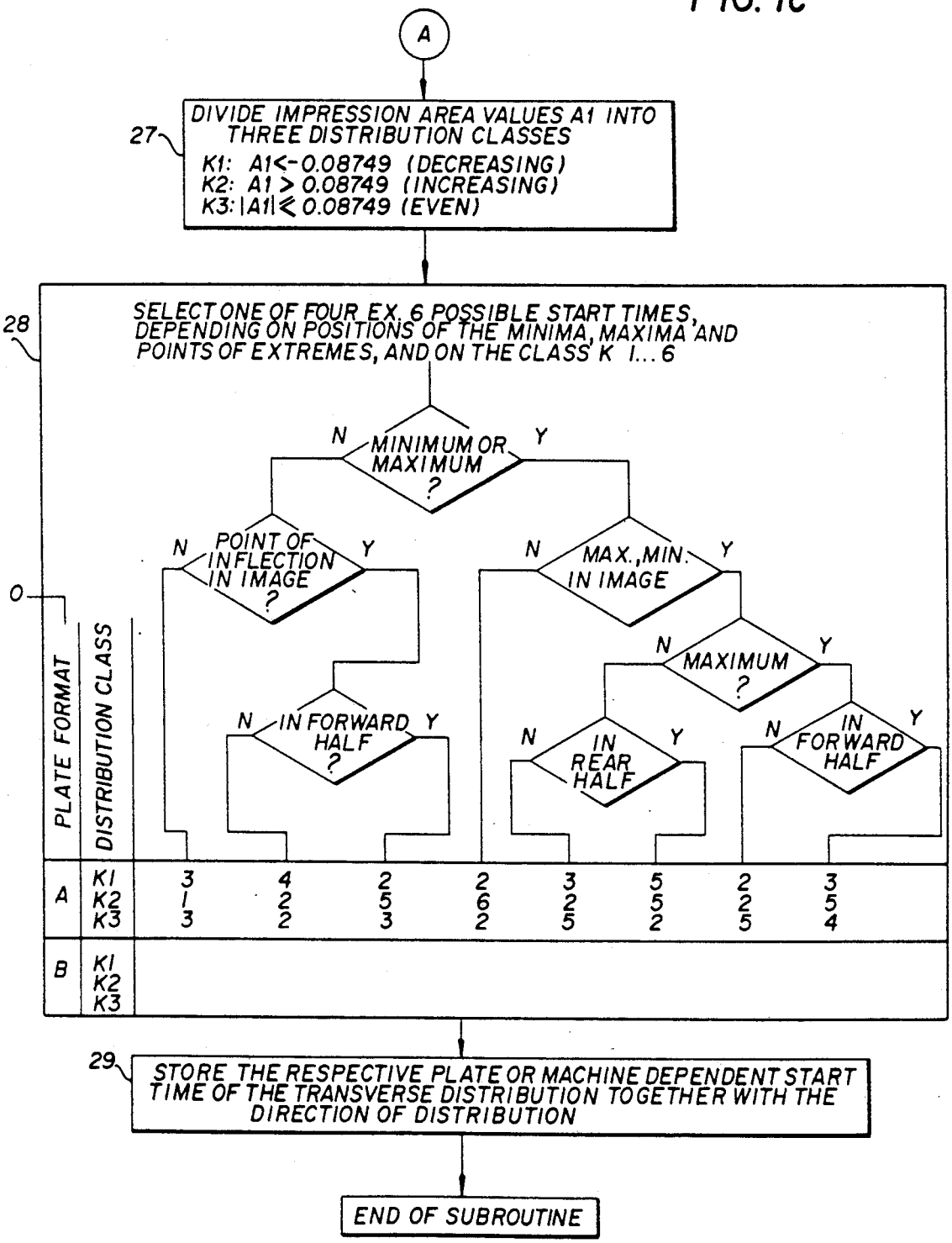

A computer program for performing the process steps shown in FIGS. 1*a*, 1*b* and 1*c* is set forth in the allotted microfiche appendix. The program is written in the Fortran language, and consists of sixteen frames. In this connection, it is possible to transfer the values directly into the control console or to enter them after intermediate storage or to enter them manually.

Figures 2A, 2B:
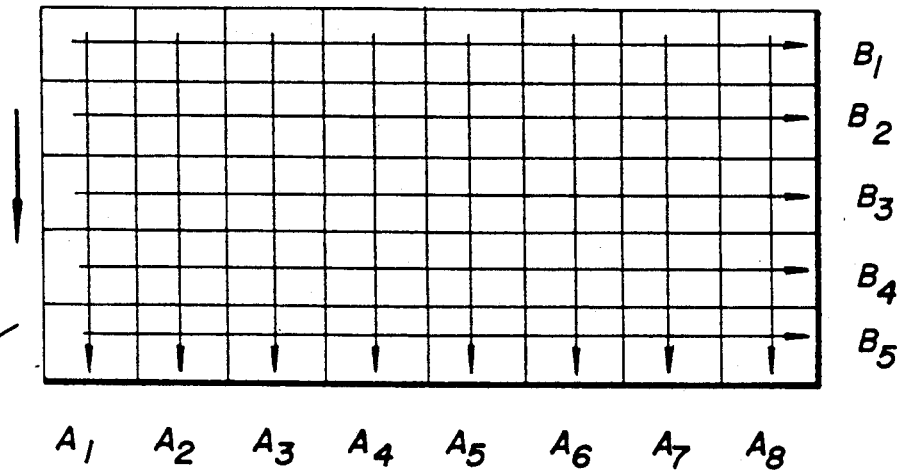
FIG. 2 are schematic representations for explaining parts of the flow chart shown in FIG. 1, showing the impression area values in matrix form.

In order to explain method steps 8 and 13 (FIG. 1*a*), there is shown in FIG. 2*a* and *b* a matrix of impression-area values. For the sake of clarity, only five lines each with eight measured values are shown. In reality, up to 704 impression-area measured values are possible with the above-mentioned printing-plate scanner In FIG. 2(*a*), the matrix is shown such that, the summation of the measured values in both directions is illustrated with reference to FIG. 2(*b*). In the printing direction indicated by the large arrow, five measured values are summed in each case to form the sums A1 to A8, and transversely to the printing direction, eight measured values are summed in each case to form the sums B1 to B5.

We claim:

1. Method for setting the starting time of a distributor roller providing a transverse ink distribution in printing machines, comprising the steps of:

(a) measuring ink density distribution data from a printing plate;

(b) obtaining the machine parameters that govern the ink distribution in a respective printing machine;

(c) computing the optimal starting time of the distributor roller from said ink density distribution data and machine parameters; and (d) starting said distributor roller at said computed starting time.

2. Method according to claim 1, comprising the step of: computing the optimal starting time for the distributor roller by means of a computer coupled to an ink density plate scanner.

3. Method according to claim 2, comprising the step of transmitting the computed starting time to an output device.

4. A method according to claim 3, which comprises the steps of reading the result of the computed starting time from the output device and entering the result manually into a control console of the printing machine.

5. A method according to claim 3, which comprises the step of reading the result of the optimal computed starting time from the output device and entering the result manually into the printing machine.

6. A method according to claim 2, which comprises the step of storing the optimal computed starting time of transverse ink distribution on a data carrier.

7. A method according to claim 2, which comprises the step of transferring the optimal computed starting time via a data line to a control console of the printing machine.

8. A method according to claim 1, which comprises the steps of computing the optimal starting time of transverse ink distribution in a computer of a control console of the printing machine after measuring the ink density distribution data with a measuring apparatus and transferring the data into the computer of the control console.

9. A method according to claim 8, which comprises the step of supplying the result of the computation of the optimum starting time of transverse ink distribution to an output device.

10. A method according to claim 9, which comprises the step of reading the result of the computation of the optimal starting time from the output device and manually entering the result into the control console of the printing machine.

11. A method according to claim 8, which includes controlling the starting time of transverse ink distribution automatically with the result of the calculation.

12. A method according to claim 1, which comprises the step of using as a parametric value in computing the optimum starting time of the transverse ink distribution, at least one of said ink density distribution data for the entire printing plate, for inking zones, for zones transverse to the printing direction and for each individual measured area.

13. A method according to claim 12, which comprises the steps of computing the ink density distribution data for individual measuring areas with a plate or film measuring device and summing them for at least one of inking zones, zones transverse to the printing direction, the entire printing plate and an entire printing film.

14. A method according to claim 1, which comprises the step of using for ink distribution data, measured ink density distribution data from an electronic composing system for inking zones transverse to the printing direction with adjustable zone widths.

15. A method according to claim 1, which further comprises the step of using for ink distribution data measured ink density distribution data from an electronic composing system for ink unit areas of adjustable size.

16. Apparatus for performing a method of setting the starting time of a distributor roller of a printing plate of a printing machine having a direction of printing, comprising a printing plate scanner for scanning the printing plate for ink distribution data, a computer in the printing plate scanner, a scanning program for scanning said printing plate in directions parallel with and perpendicular to the direction of printing, a first memory in said computer for storing said scanning program, a second memory in said computer for storing said ink distribution data, and an output device connected to the computer for indicating the starting time for the distributor roller.

17. Apparatus for performing a method of setting the starting time according to claim 16, further comprising a control console connected to said printing machine, including a record memory in said computer for storing parameters of the printing machine, and including at least one input device connected to said printing machine for receiving said starting time.

* * * * *